United States Patent [19]

Jordan

[11] 4,221,113

[45] Sep. 9, 1980

[54] TOOL FOR SEPARATING AND CONNECTING LINKS OF FLAT CHAIN BELT

[76] Inventor: Ronald C. Jordan, Rte. 2, Belle Center, Ohio 43310

[21] Appl. No.: 33,124

[22] Filed: Apr. 25, 1979

[51] Int. Cl.[3] ..... B21L 21/00

[52] U.S. Cl. ..... 59/7

[58] Field of Search ..... 59/7, 11, 1, 8, 35

[56] References Cited

U.S. PATENT DOCUMENTS

| | | | |
|---|---|---|---|
| 2,691,267 | 10/1954 | Baber | 59/7 |
| 2,711,628 | 6/1955 | Glanz | 59/7 |
| 2,826,893 | 3/1958 | Falk | 59/7 |
| 3,041,820 | 7/1962 | Timmerman | 59/7 |
| 3,233,402 | 2/1966 | Urbaitis | 59/7 |

*Primary Examiner*—Francis S. Husar
*Assistant Examiner*—Gene P. Crosby
*Attorney, Agent, or Firm*—Francis T. Kremblas, Jr.

[57] ABSTRACT

An apparatus for separating the links of flat conveyor chain in situ which is characterized by a clamp portion adapted to firmly grip a link in the chain and a base portion which includes a forcing rod positioned to engage the edge of the next adjacent link to push said edge out of engagement with the link being held by the clamp portion. The clamp portion comprises a pair of parallel extending leg portions which are spaced from one another to receive the link member. An opening provided in said leg portions through which a locking member is extended to secure the link disposed between the legs such that the connection between the adjacent link is aligned with the forcing rod.

5 Claims, 4 Drawing Figures

TOOL FOR SEPARATING AND CONNECTING LINKS OF FLAT CHAIN BELT

BACKGROUND

Flat type conveyor chain is widely used as a flexible drive chain or connection in a variety of heavy equipment. Particularly it is used in many types of farm equipment.

This type of chain is characterized by a generally square shaped or rectangular link which has a leading edge connected to the trailing edge of the next adjacent link. The trailing edge comprises a split cylinder portion which laterally and slideably receives the leading edge of the next adjacent link which is provided with a laterally extending flange preventing separation of the links in a longitudinal direction which of course, is the direction of the major load carried by the connected links. The lateral engagement between links is basically a force type fit which renders them secure against inadvertent lateral disengagement.

This type of chain is machine made, generally in a stamping operation. Users however, must connect various lengths together for special length requirements or separate them for repair of existing chain belts on various equipment and then connect them for further use.

Prior to the present invention, when a chain of this type became damaged, it has been generally necessary to remove the whole chain from the piece of machinery where it was being employed and take it to a remote location where a vice or the like was available. By placing the appropriate link in a conventional vice, a rod of appropriate diameter could be used to drive the leading edge of one link laterally with a hammer or the like to separate the leading edge from the trailing edge of the next adjacent link carrying the split cylinder type receiver.

This time consuming procedure is especially costly during spring planting or fall harvesting seasons down time of equipment often wastes precious daylight hours. Further, this prior required procedure is rather awkward and clumsy in and of itself.

However, prior to the present invention, there has never been a device which would enable one to repair flat chain of this type in situ in a relatively quick and convenient manner.

SUMMARY OF INVENTION

The present invention relates to an apparatus or tool which is adapted to quickly connect and disconnect links of a flat conveyor chain from one another without removing the chain from the piece of machinery on which it is mounted or at least not requiring removal of the whole chain to a distant location for repair or maintenance.

The apparatus of the present invention represents a unitary tool which securely holds a link portion of the chain in a fixed position relative to the adjacent links in alignment with a forcing rod which engages the leading edge of the next adjacent link portion to forcably push it axially through the split cylinder portion provided on the trailing edge of the link that is secured by the apparatus.

The link is securely held between a pair of parallel extending legs or holding members which are spaced from one another to receive the flat link between them. An opening is formed in the legs which receives a removably mounted securing means, preferably in the form of a threaded bolt and a nut or nut-like receiver. The bolt may then be extended through the opening in the leg portions and the center opening of the link and fastened into secure engagement with the link to lock the link between the parallel leg portions.

The forcing rod is preferably positioned in a base portion joined to the leg portions and preferably is in the form of a threaded bolt extended through a threaded hole in the base. When the link is securely in position, rotating the threaded bolt drives the bolt into forcing contact with the leading edge of the link next adjacent to the link secured between the parallel leg portions.

In a similar but reverse manner, a new link member may be driven into a connecting relationship to replace a worn or damaged link or to connect separated end of the chain. Often links may be removed and re-connected to simply shorten a conveyor chain which has become stretched through prolonged use.

OBJECTS

It is therefore an object of the present invention to provide an apparatus for connecting and disconnecting the links of flat type conveyor chain in situ in an efficient and more convenient manner than prior methods and means.

It is another object to provide an apparatus of the type described which is of relatively compact construction and design such that it may be employed where access space to the chain is relatively limited.

It is another object of the present invention to provide an apparatus of the type described which is relatively simple and low cost to manufacture.

IN THE DRAWINGS

DETAILED DESCRIPTION

Figure 1:
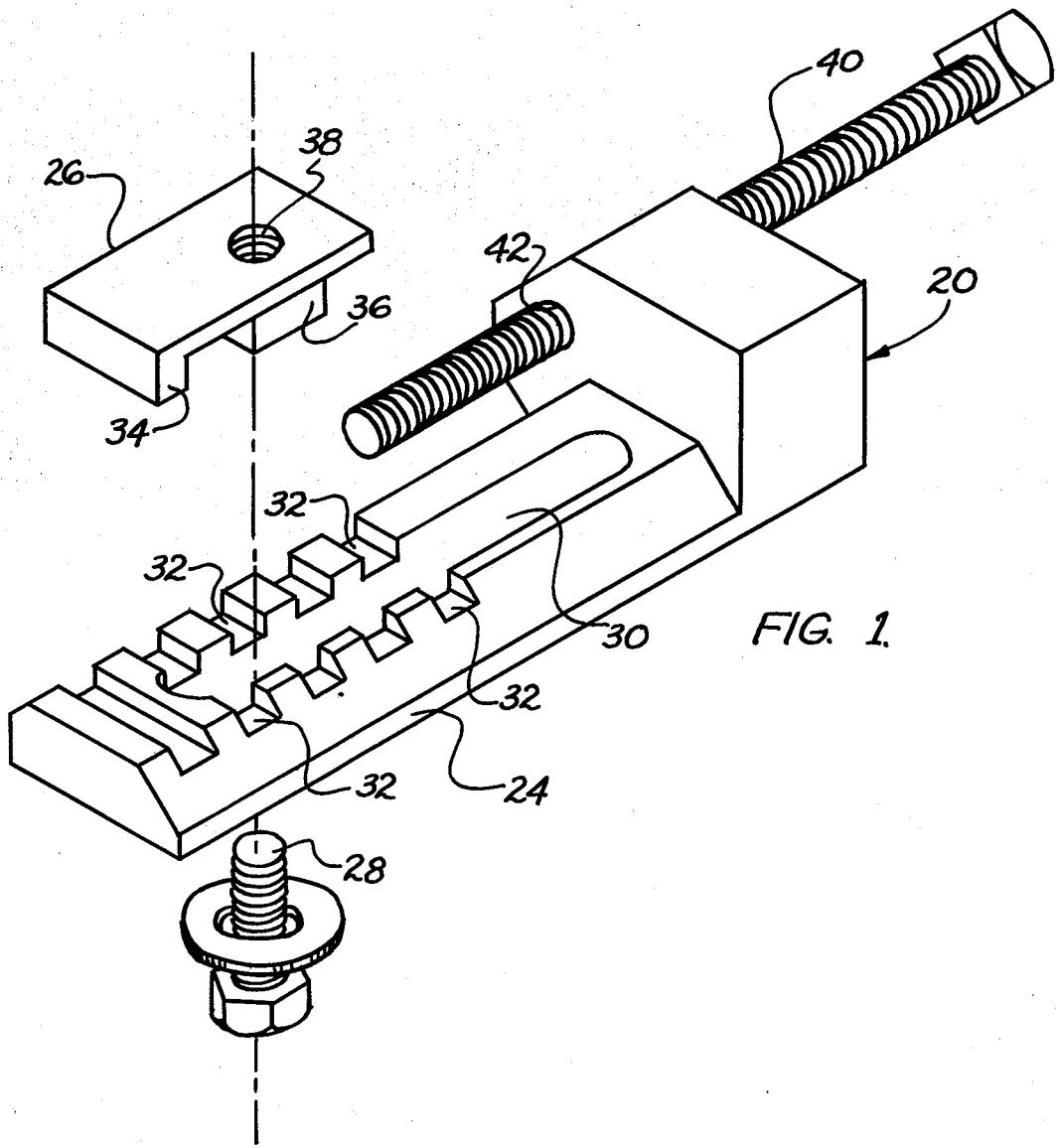
FIG. 1 is an exploded perspective view of an apparatus constructed in accordance with the present invention.

An apparatus for connecting or dis-connecting links of a flat chain conveyor belt constructed in accordance with the present invention is illustrated in FIG. 1 and includes a base portion, indicated generally at 20, and a holding or link gripping portion indicated generally at 22.

The link gripping portion includes a first leg 24 which preferably is integrally formed with base 20. A strong material such as a steel alloy is preferred to provide sufficient strength.

A second leg 26 of shorter length is provided which is removably mounted and extends parallel to but spaced from first leg 24, when it is attached by a locking bolt 28 to first leg 24.

Leg 24 is provided with a longitudinally extended slot or opening 30 and includes a plurality of notches 32 aligned with similar nothces 32 along the face of leg 24 on each side of a portion of slot 30.

Leg 26 includes a flange portion 34 and a downwardly extending nut-like portion 36 provided with a threaded bore 38 which is adapted to receive threaded locking bolt 28.

Flange portion 34 is adapted to be received in opposing slots 32 and nut portion is of a size to extend at least partially into slot 30 of leg 24 when leg 26 is mounted to leg 24.

Base 20 is provided with a forcing rod in the form of threaded bolt 40 extended through a threaded bore 42.

To illustrate the use of the present invention, adjacent connected links 44, 46 and 48 are shown which could be a portion of much longer series of such links in a typical flat chain belt.

Each such link conventionally includes a leading edge A and a trailing edge B. Edge A includes flange like protrusions which are adapted to be slideably force fit within a split cylindrical portion of trailing edge B of the next adjacent link 46.

The user disposes leg 24 under a link of a chain such as link 46, with the upper surface of leg 24 as seen in FIG. 1 next to the link. Leg 24 is positioned such that slot 30 is aligned with the center opening of link 46. Next leg 26 is disposed on the opposite side if link 46 with nut-like extension passing through the center opening of the link and with flange 34 disposed in opposing notches 32 of leg 26. While holding each of the components described in this configuration with one hand, bolt 28 is extended through the opposite side of slot 30 and through the center opening of link 44 in alignment with bore 38. Bolt 28 is then manually turned to engage threaded bore 38 until finger tight pressure is applied to temporarily secure the described positioning.

Then a suitable wrench or the like is used to tighten bolt 28 until the link is securely locked between legs 24 and 26 against any movement along their length.

Next, threaded forcing rod is rotated in a direction to move inwardly into engagement with the leading edge portion A of link 46 mounted within the trailing edge B of link 44. Link 44 is manually pivoted a few degrees to aligned its sides C with the opening of the split cylinder of edge B. When the edge A moves inwardly such that side C is within the cylindrical portion B it becomes unnecessary to manually hold it in position. Rod 40 is positioned to be automatically aligned with edge A for chain links of a given size range. Some adjustment can be made in the positioning of link 44 prior to final tightening of bolt 28 to accomodate this alignment.

Figure 2:
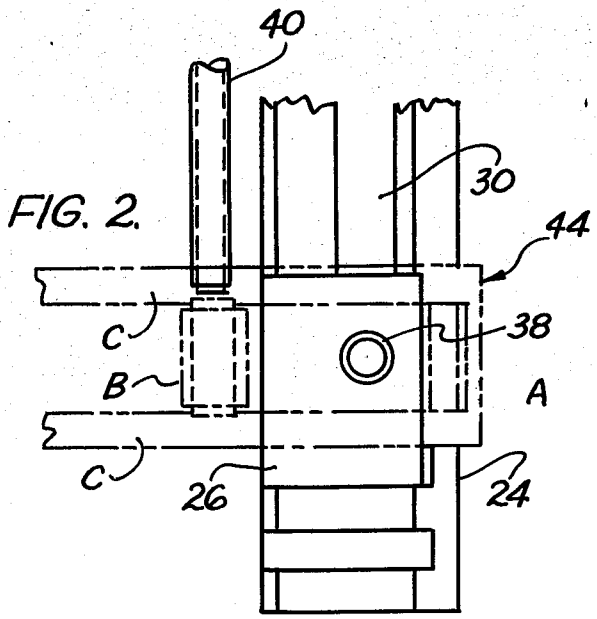
FIG. 2 is a partial plan view of a portion of the apparatus of FIG. 1 illustrating the relationship of the locking mechanism and a portion of a flat chain belt to be separated.

A wrench or other suitable tool, can then be used to continue turning rod 40 to increasingly push against edge A as shown in FIG. 2, eventually forcing it and the companion side portion C completely through the split cylindrical portion of edge B.

If the object of the separation of the chain is merely to shorten the overall length, this same process is merely repeated for the next link connection until a sufficient number of links have been removed.

If the object is to replace a link or increase the length of the chain belt, the apparatus of the present invention may be used to join links to one another.

This may be accomplished by a procedure which, in essence, is the reverse of the procedure described above.

Figure 3:
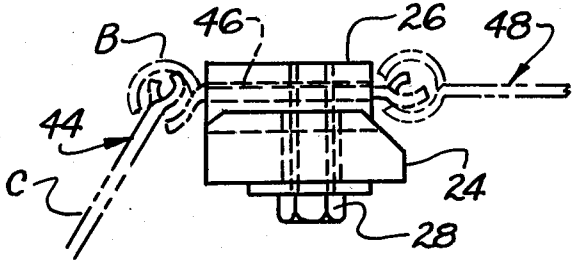
FIG. 3 is an end view of that portion of the apparatus shown in FIG. 2.

In this instance the leading edge A of the unconnected link is aligned with the trailing edge B of the link being held in manner shown in FIGS. 2 and 3. However, the leading edge A is manually aligned with the opening of the split cylinder portion and the end of the forcing rod 40 with the unconnected link being disposed inwardly toward the base portion 20.

Turning rod 40 exerts force upon the leading edge A to drive it into the split cylinder portion B until the link connection is complete.

Once the leading edge A penetrates a short distance into edge B, manual guidance of the loose link is generally not necessary.

Figure 4:
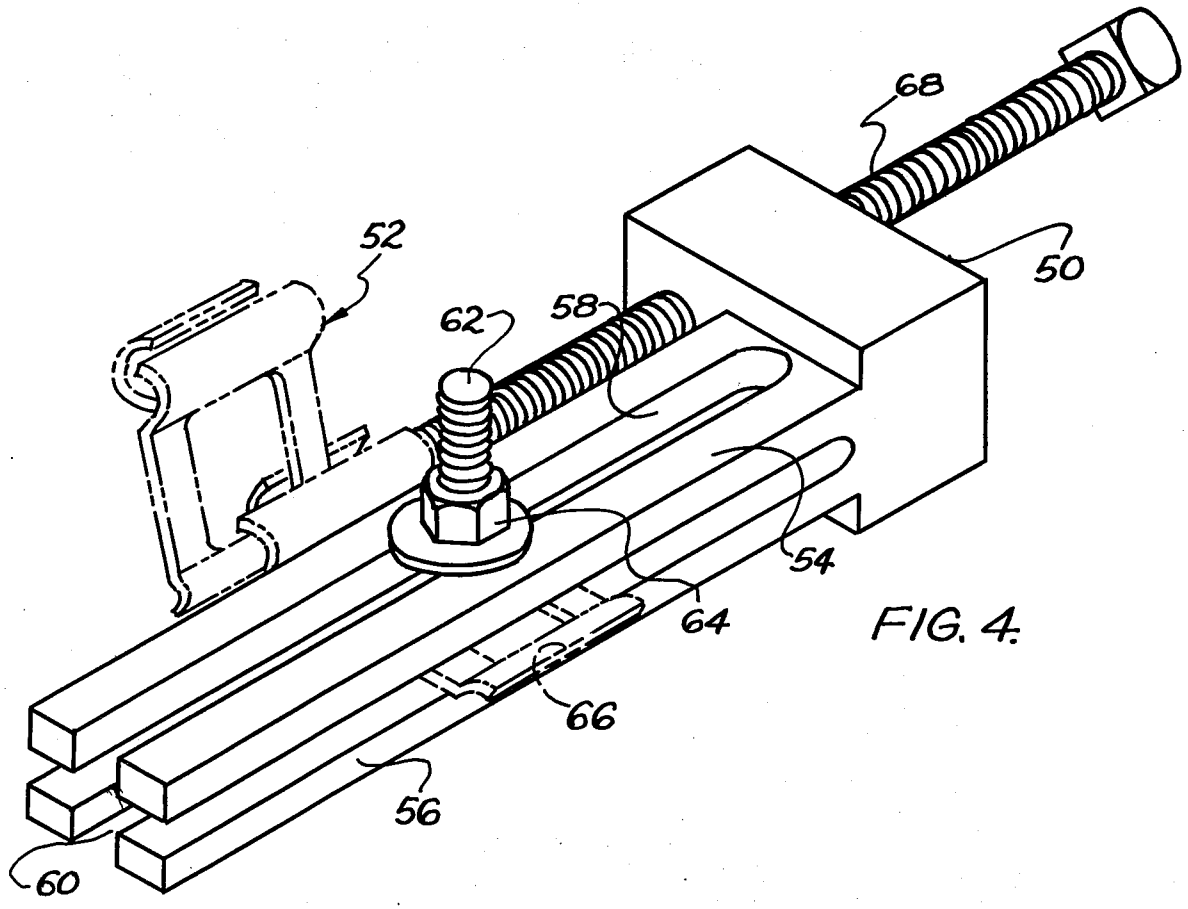
FIG. 4 is a perspective view of another embodiment of an apparatus constructed in accordance with the present invention.

Another embodiment of the present invention is illustrated in FIG. 4 and essentially functions in a similar manner to the embodiment shown and described in the preceding Figures.

This embodiment includes a base portion 50 and a link retaining portion indicated generally at 52 which includes a pair of parallel extending leg portion 54 and 56. Each leg portion preferably is integrally formed with base 50 and are vertically spaced from one another as shown in FIG. 4. Further leg portions 56 and 56 include longitudinally extending slots 58 and 60 which are aligned with one another along a given length of the leg portions.

A bolt 62 similar to bolt 28 shown in FIG. 1, is provided with a nut and washer assembly 64. Bolt 62 may be extended through slot 58 and 60 and fastened tightly to grip one of links in a chain, such as 66, in a manner similar to that described in connection to FIG. 1.

An identical threaded forcing rod 68 mounted in a threaded bore in base 50 is provided in identical fashion to forcing rod 40 referred to in FIG. 1.

In view of the above description, it should be readily apparent that the embodiment in FIG. 4 functions in nearly identical manner to the embodiment described in FIG. 1 therefore it appears unnecessary to repeat an operational description.

One of the advantages of the embodiment shown in FIG. 4 is that both leg portion are permanently attached to base 50 and therefore a link may be positioned with somewhat greater ease between the legs 54 and 56 and the nut and washer assembly 62 may be manipulated in connection therewith with more facility in some situations.

However, both embodiments work generally equally as well and clearly represent a drammatic improvement over prior methods and means.

Each is very handy to carry on one's person or in a small tool box which may be carried on mobile equipment such as tractors, harvestors or pickers and the like. Therefore any repair of a chain may be attended to in the field as quickly as possible in a relatively simple manner to reduce the lost time and frustration which was required to accomplish the same purpose prior to the present invention.

I claim:

1. An apparatus for connecting or disconnecting flat link type chain belts comprising in combination;

a frame means including a base portion and link-retaining portion extending outwardly from said base portion, said retaining portion including a pair of parallel extending legs spaced from one another to form an opening between said legs adapted to slideably receive a link of flat chain belt;

a longitudinally extending slot in at least one of said legs;

a threaded fastener means extended through said slot and into engagement with a link disposed between said legs to releasably lock said link between said leg portions; a threaded rod threadably mounted in said base portion and having an inner end aligned with the link connection between the link locked between said legs and a next adjacent link means whereby said threaded rod may be driven into force transmitting engagement with the link connection between said adjacent links to force said connected portions apart from one another.

2. The apparatus defined in claim 1 wherein one of said parallel extending legs is fixed to said base means and the other leg is removably mounted in a fixed relationship to said fixed leg and includes a threaded bore for receiving a threaded bolt included in said fastener means.

3. The apparatus defined in claim 2 wherein said removably mounted leg includes a turned flange portion and said fixed leg includes a plurality of notches adapted to receive said flange portion.

4. The apparatus defined in claim 1 wherein said parallel extending legs are integrally formed with said base portion and each include a longitudinal slot adapted to receive a bolt and nut assembly extended through said slots and through a center opening provided in said link to lock said link firmly between said leg portions.

5. A work tool for connecting or separating adjacent links of a flat link chain of the type comprising a split cylinder type receiver portion which laterally receives a flanged end portion of the next adjacent link in a force-transmitting engagement comprising, in combination, a frame means including a base portion and a link retaining portion, said link retaining portion including a pair of leg members extending outwardly from said base portion in substantially parallel relationship to one another and spaced from one another to form a link-receiving opening between said leg members, at least one of said leg members being fixed to said base portion and including a longitudinally extending slot; locking means removably mounted to said leg members to secure the position of a link disposed in said link receiving opening; and a forcing rod movably mounted in said base member and aligned for force-transmitting engagement with the flanged end portion of a link aligned with the receiver portion of a link locked between said leg members.

* * * * *